US009883722B2

(12) United States Patent
Marti

(10) Patent No.: US 9,883,722 B2
(45) Date of Patent: Feb. 6, 2018

(54) WRISTWATCH COMPRISING A CLASP CONNECTED TO THE CASE

(71) Applicant: G. et F. Châtelain SA, La Chaux-de-Fonds (CH)

(72) Inventor: Philippe Marti, Colombier (CH)

(73) Assignee: G. et F. Châtelain SA (CH)

( * ) Notice: Subject to any disclaimer, the term of this patent is extended or adjusted under 35 U.S.C. 154(b) by 0 days.

(21) Appl. No.: 15/362,036

(22) Filed: Nov. 28, 2016

(65) Prior Publication Data

US 2017/0150790 A1 Jun. 1, 2017

(30) Foreign Application Priority Data

Nov. 26, 2015 (CH) ..... 1726/15

(51) Int. Cl.

| | |
|---|---|
| ***G04B 37/14*** | (2006.01) |
| ***A44C 5/24*** | (2006.01) |
| ***G04D 99/00*** | (2006.01) |
| ***A44C 5/14*** | (2006.01) |
| ***G04B 45/00*** | (2006.01) |

(52) U.S. Cl.

CPC ..... *A44C 5/24* (2013.01); *A44C 5/147* (2013.01); *G04B 37/1486* (2013.01); *G04B 45/0069* (2013.01); *G04D 99/00* (2013.01)

(58) Field of Classification Search

CPC .... G04B 37/14; G04B 37/00; G04B 37/1486; A44C 5/24; A44C 5/147; G04D 99/00; G04F 5/0069

USPC ..... 224/164; 24/265 WS, 71 J

See application file for complete search history.

(56) References Cited

U.S. PATENT DOCUMENTS

| | | | | |
|---|---|---|---|---|
| 3,782,105 | A * | 1/1974 | Nozawa | G04B 37/0008 368/292 |
| 3,844,458 | A * | 10/1974 | Lanvin | A44C 5/12 224/170 |
| 4,747,604 | A | 5/1988 | Nakamura | |
| 5,005,161 | A * | 4/1991 | Boilen | G04B 47/046 368/295 |
| 5,181,192 | A * | 1/1993 | Paratte | G04C 3/008 368/204 |
| 7,591,581 | B2 | 9/2009 | Lovegrove et al. | |

(Continued)

FOREIGN PATENT DOCUMENTS

| | | | |
|---|---|---|---|
| CH | 156174 | A | 7/1932 |
| DE | 1303173 | U | 10/1933 |

(Continued)

*Primary Examiner* — Sean Kayes
(74) *Attorney, Agent, or Firm* — Blank Rome LLP

(57) ABSTRACT

A wristwatch, comprising:

a watch case (2);

a clasp (3), said clasp comprising a frame (4) that can clip over the top of the watch case (2) in a closed position, and that can be unfastened from the watch case (2) in an open position;

a bracelet (12), said bracelet comprising a single strand, said strand having a first end (120) and a second end (121);

said first end being connected to said watch case (2) and said second end being connected to the clasp (3);

a locking member (5) connected to the watch case, the locking member being able to be pivoted between a position that allows it to be inserted into the opening (40) of the frame (4) when the clasp (3) is being closed or opened, and a locking position that allows the opening or closure of the clasp (3) to be blocked.

11 Claims, 10 Drawing Sheets

(56) References Cited

U.S. PATENT DOCUMENTS

| | | | | |
|---|---|---|---|---|
| 2006/0114753 | A1* | 6/2006 | Gerber | G04B 19/283 368/295 |
| 2014/0029394 | A1* | 1/2014 | Saunier | A44C 5/14 368/285 |
| 2015/0346692 | A1* | 12/2015 | Bolzt | G04B 37/04 368/314 |

FOREIGN PATENT DOCUMENTS

| | | | |
|---|---|---|---|
| EP | 0545229 | A1 | 6/1993 |
| FR | 767942 | A | 7/1934 |
| FR | 912561 | A | 8/1946 |
| WO | WO-2005/089584 | A1 | 9/2005 |

* cited by examiner

A-A

C-C

WRISTWATCH COMPRISING A CLASP CONNECTED TO THE CASE

RELATED APPLICATIONS

This application claims priority of Swiss Patent application CH1726/15 filed on Nov. 26, 2015, the contents of which is hereby enclosed by reference.

TECHNICAL FIELD

The present invention relates to a wristwatch comprising a watch case, a bracelet and a clasp connected to the watch case.

PRIOR ART

The bracelet straps of wristwatches generally comprise a clasp to enlarge the bracelet or open it in order to allow the watch to be put on or taken off. The clasp is generally provided on the opposite side to the watch case and is thus intended to be worn against the inside of the wrist. These clasps are therefore uncomfortable, particularly for sport or when the wrist is resting on a table or a desk top.

In order to avoid this problem, the prior art also knows wristwatches comprising a bracelet clasp that is incorporated into or secured to the watch case. One example of such a construction is described for example in CH156174 describes a wristwatch the case of which is combined with an unfolding clasp that allows the length of the bracelet to be varied.

A similar solution is described in U.S. Pat. No. 4,747,604 and in DE4303173.

In all of these solutions, the watch case incorporates a deployable clasp that allows the bracelet to be enlarged but not opened up completely. It is therefore difficult, particularly for individuals with reduced mobility in their hand, to put these watches on or take them off. In addition, these watches cannot be laid out flat for display in a window display for example.

A deploying clasp under the watch back also makes the back more difficult to access, for example when the back needs to be opened in order to access the movement or replace a battery for example.

In addition, the components that allow the clasp to be manipulated in order to open or close it are generally situated near the back of the watch, in a plane below the plane of the dial. They are therefore difficult to manipulate.

BRIEF SUMMARY OF THE INVENTION

It is an object of the present invention to propose a wristwatch with a case connected to the clasp but which does not have the limitations of the known wristwatches of this type.

According to the invention, these objects are notably achieved by means of a wristwatch comprising:

- a watch case;
- a clasp, said clasp comprising a frame that can clip over the top of the watch case in a closed position, and that can be unfastened from the watch case in an open position;
- a bracelet, said bracelet comprising a single strand, said strand having a first end and a second end;
- said first end being connected to said watch case and said second end being connected to the clasp;

- a locking member connected to the watch case, the locking member being able to be pivoted between a position that allows it to be inserted into the opening of the frame when the clasp is being closed or opened, and a locking position that allows the opening or closure of the clasp to be blocked.

The bracelet is considered to be opened up when it no longer forms a closed ring, namely when the clasp is connected to the case only by the bracelet, without being fixed directly to this case.

This solution notably offers the advantage that the watch can be put on or taken off without the need for a clasp on the inside of the wrist.

The use of a single-stranded bracelet means that the bracelet can be opened up completely and makes putting the watch on or taking the watch off easier, particularly for individuals with reduced mobility in their hand.

The clasp is closed over the top of the watch case and can therefore be manipulated with ease.

The clasp may comprise manipulating members, for example studs or even push-buttons, which lie above the dial plane when the clasp is locked to the watch case.

The frame can clip over the top of the watch case in the closed position. The dial and the hands of the watch can be seen through an opening in this frame when the clasp is closed.

In one embodiment, the watch comprises at least one dial, the frame comprising a central opening, at least one dial being visible through said central opening.

The clasp thus forms a watch case bezel, namely a member on top of the watch middle and completely surrounding the glass.

The wristwatch comprises a locking member connected to the watch case. The locking member can be pivoted between a position that allows it to be inserted into the opening of the clasp when the clasp is being closed or opened, and a locking position that allows the opening or closing of the clasp to be blocked.

In the open position, at least one portion of the locking member may be longitudinal, which means to say parallel to the bracelet. In the locking position, at least one portion of the locking member may be transverse, namely perpendicular to the bracelet.

The manipulatable portion of the locking member advantageously lies above the watch glass.

The locking member may have a T-shape with a pivoting shaft connected to the watch case, and a head that can be oriented either in a first direction that allows insertion of the clasp or in a second direction pressing against said frame.

In one embodiment, the shaft of the locking member can be lifted above the dial in order to pivot it.

The watch case may comprise spring-loaded balls able to collaborate with notches in the clasp in order to keep said clasp closed.

It is possible to provide balls only on the distal side of the clasp. It is possible to provide balls both on the distal side and on the proximal side of the clasp.

In one embodiment, the wristwatch comprises two dials and a separation between the two dials, the shaft of the locking member being mounted on this separation.

The wristwatch may comprise a first movement for displaying time information on a first dial. A second movement may be provided for displaying time information on the second dial.

In order to improve security and reduce the risk of unwanted opening, the clasp may comprise a push-button with a return spring. This return spring pushes the push-button back into the locking position when the push-button is not being pressed, the opening of the clasp being blocked in this locking position.

To this end, the push-button may be provided on lateral faces of the clasp, so as to move in a plane above the bracelet. The push-button thus does not dig into the wrist.

It is also possible to provide two push-buttons on the two longitudinal faces of the clasp, and which need to be actuated simultaneously in order to open the clasp.

The push-button may be guided by means of rods engaged in through-holes through the clasp, each rod collaborating with a pivot or another element engaged in the watch case in order to lock or unlock the clasp. The rods may for example push this element back into the case in the unlocking position.

BRIEF DESCRIPTION OF THE FIGURES

Exemplary embodiments of the invention are indicated in the description which is illustrated by the attached figures in which.

EXEMPLARY EMBODIMENT(S) OF THE INVENTION

Figure 1:
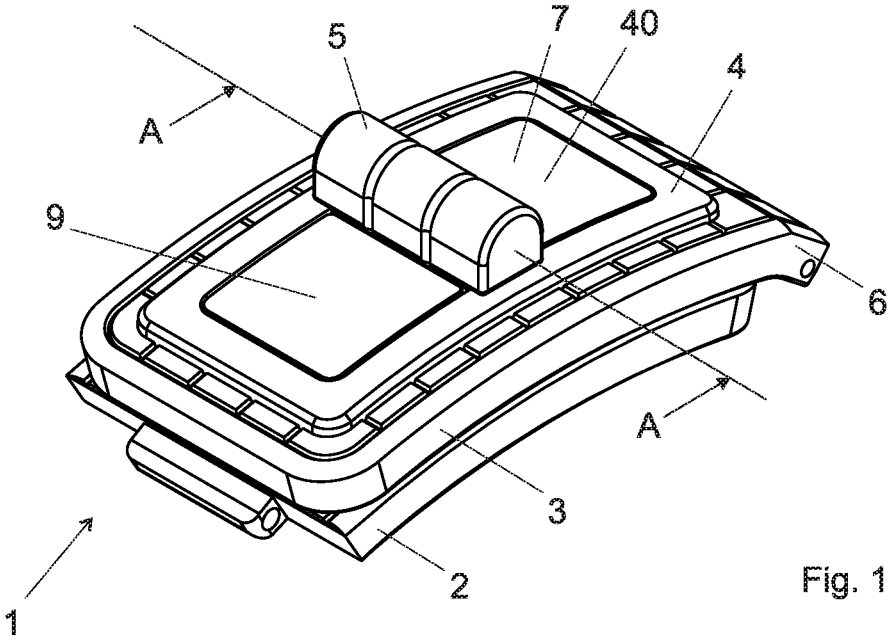
FIG. 1 illustrates a perspective view of a first embodiment of a wristwatch according to the invention, the clasp being closed and locked.
Figure 2:
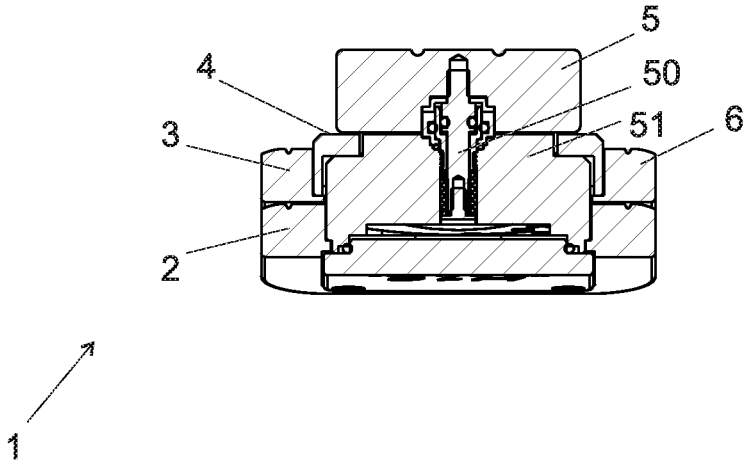
FIG. 2 is a view in cross section on A-A of the watch of FIG. 1.
Figure 3:
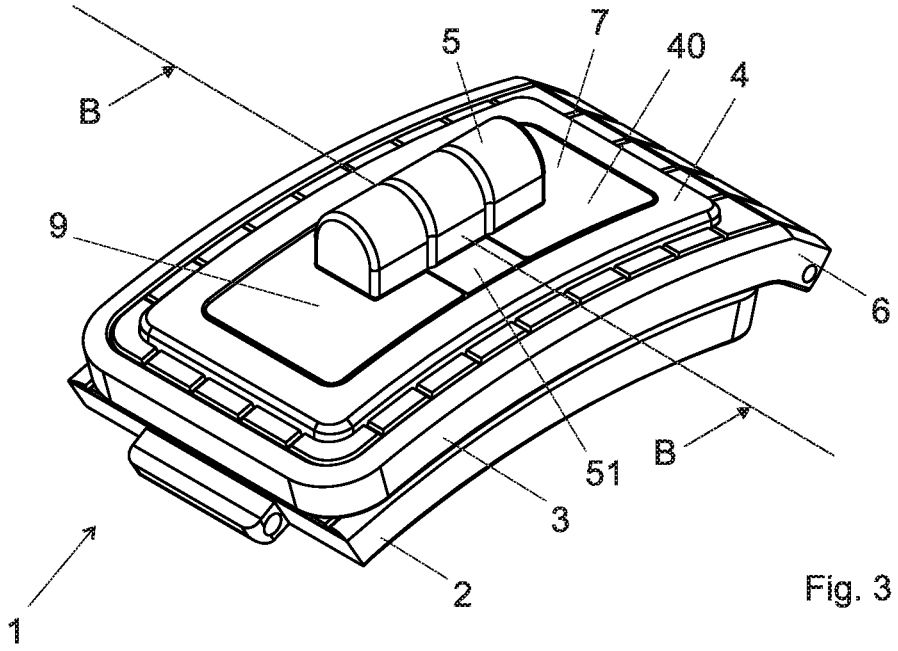
FIG. 3 illustrates a perspective view of the first embodiment of a wristwatch according to the invention, without the bracelet, the clasp being closed but unlocked.
Figure 4:
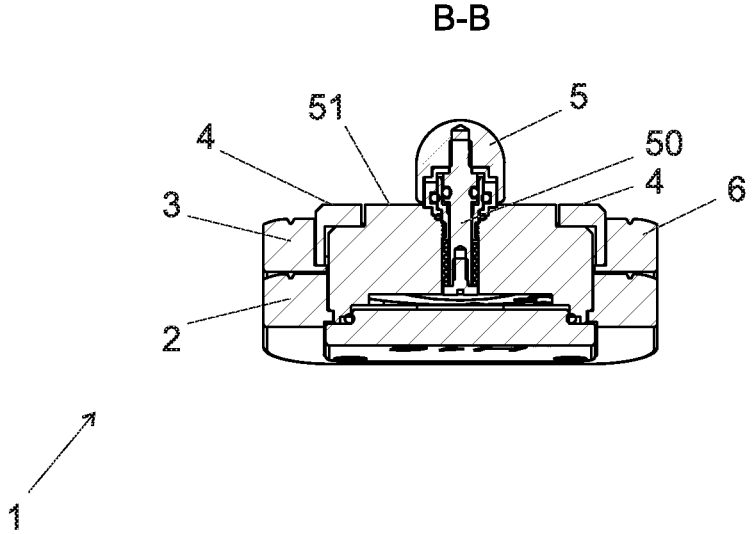
FIG. 4 is a view in cross section on B-B of the watch of FIG. 2.

One embodiment of a wristwatch 1 according to a first embodiment of the invention is illustrated by way of example in FIGS. 1-9.

The wristwatch 1 comprises, on the one hand, a watch case 2 and, on the other hand, a clasp 3 that can be locked over the top of the watch case, or unlocked for opening. A first end 120 of the single-stranded bracelet 12 is connected to one side of the clasp (for example in the 12-o'clock position) while the second end 121 of the bracelet is connected to the other side of the watch case 2 (in the 6-o'clock position). In the unlocked position, the bracelet can therefore be opened up completely and the watch laid out flat with the watch case 2 and the clasp one at each end of the bracelet.

The clasp 3 comprises a base 6 that can be clipped onto the case 2, around the glass or glasses, in the manner of a bezel. A frame 4 on this base defines an opening 40 through which the dial or dials of the watch can be seen when the clasp is closed onto the watch case 2.

The watch case 2 comprises a watch middle 8 around which the frame 4 can clip. Elastic elements, for example two spring-loaded balls 80, are provided on the external face of the watch middle, in the 6-o'clock position, to hold the frame 4 in the closed position. Notches or housings may be provided at the 6-o'clock position in the internal face of the frame 4 to house the head of these balls when the clasp is closed. Spring-loaded balls may also be provided in the 12-o'clock position on the external face of the watch middle, along with corresponding notches in the 12-o'clock position in the internal face of the frame 4.

The watch case 2 further comprises, in this example, two glasses separated from one another by the base 51 of the locking member 5. The two dials 7, 9 are visible behind these glasses through the opening 40 of the frame 4 when the clasp 3 is closed. One dial may be visible behind each glass. In one embodiment, the watch middle 8 houses two movements 10, 11; the movement 10 is able to display a first piece of time information in front of the dial 7 while the movement 11 is able to display another piece of time information in front of the dial 9. The two pieces of information may, for example, correspond to the time in two different time zones or to a time and a timed duration. It is also possible to display information not connected with the time behind one of the glasses, for example data from temperature, altitude, location, heart rate sensors, messages, calendar information, etc. It is also possible to display time information behind one of the glasses and a decoration or non-time information behind the other glass.

In the case of a skeleton watch, the dial may consist of the mainplate or a bridge. In the case of a watch with an electronic display, the dial may consist of a display.

The base 6 of the clasp 3 is positioned above the watch case 2 by means of shapes 81 of the watch middle which are housed in notches 60 of the base 6 in the closed position. In one embodiment, one or more shapes are provided at the 12-o'clock position and one or more shapes are provided at the 6-o'clock position.

Figure 5:
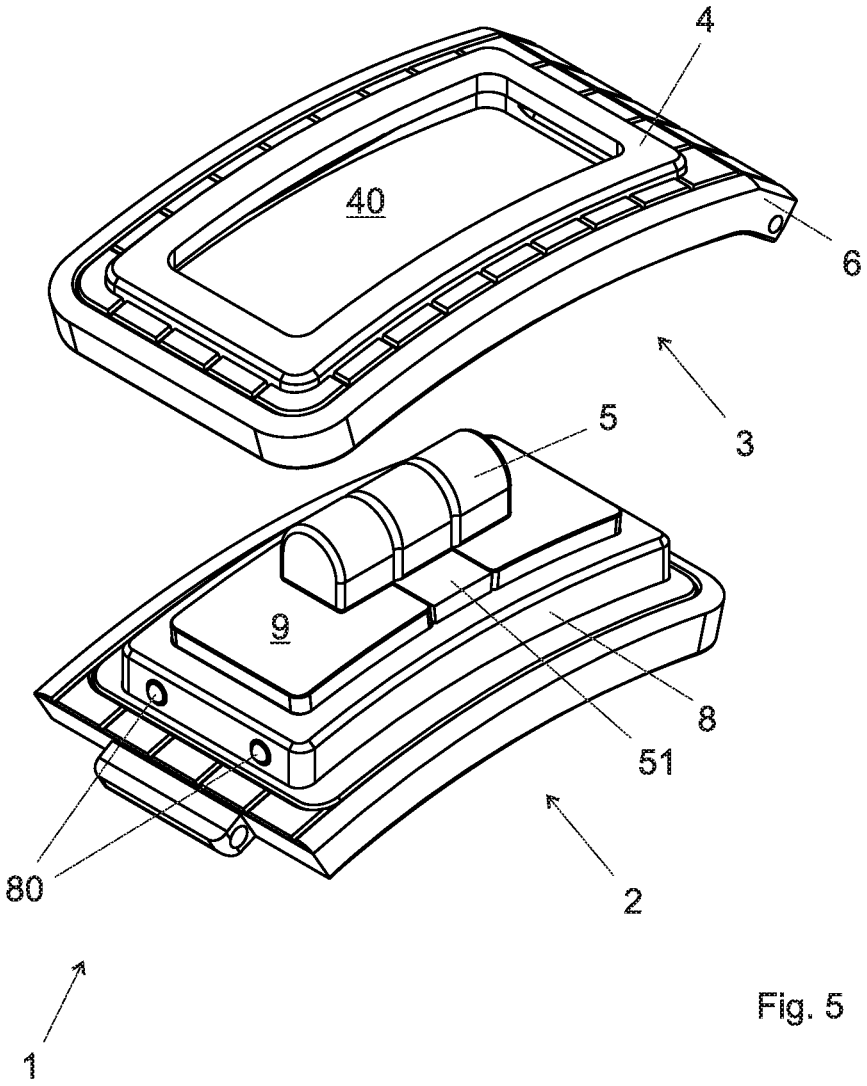
FIG. 5 illustrates a perspective view of the first embodiment of a wristwatch according to the invention, without the bracelet, the clasp being open over the top of the watch case.
Figure 6:
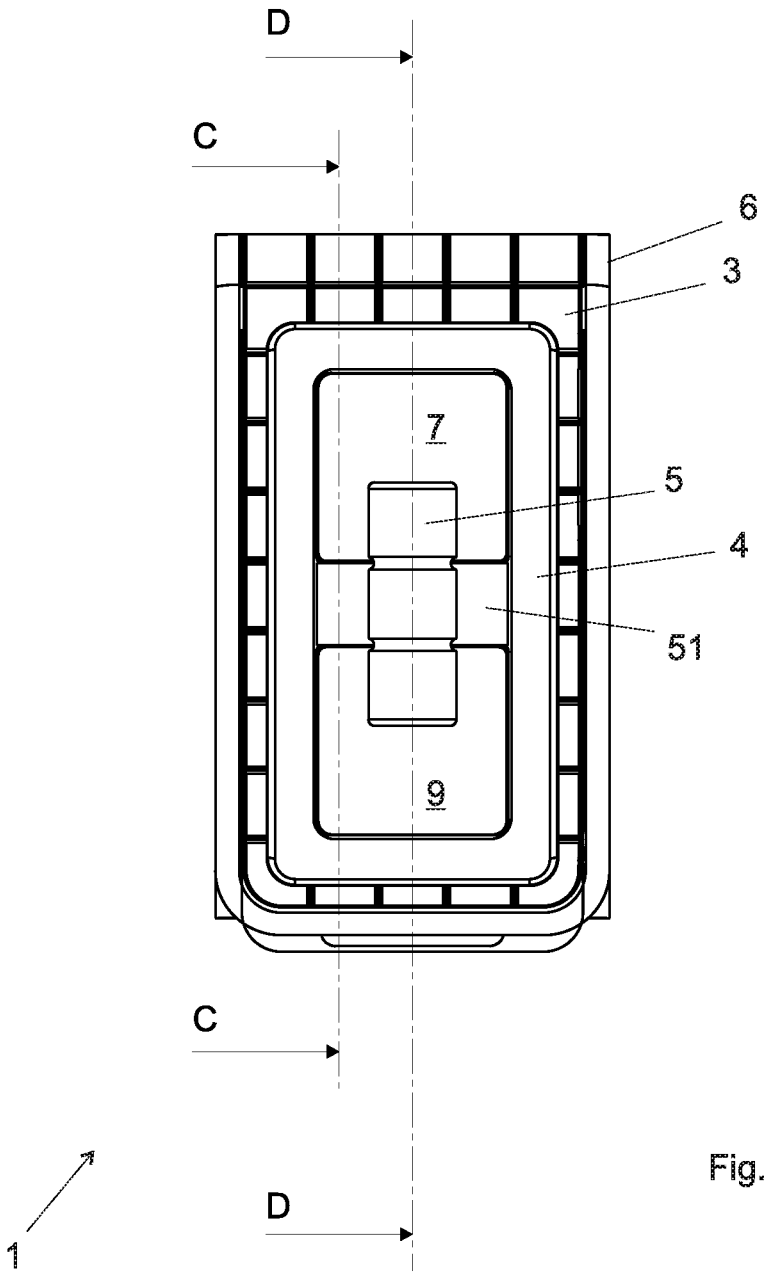
FIG. 6 illustrates a view from above of an embodiment of a wristwatch according to the invention, without the bracelet, the clasp being closed but unlocked.
Figure 7:
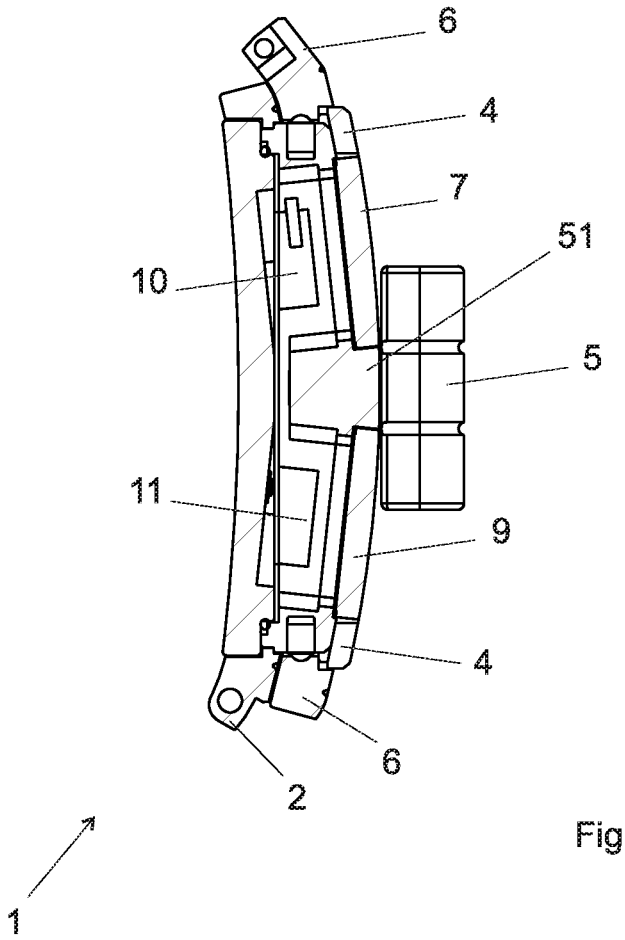
FIG. 7 is a view in longitudinal section on C-C of the watch of FIG. 6, without the bracelet.
Figure 8:
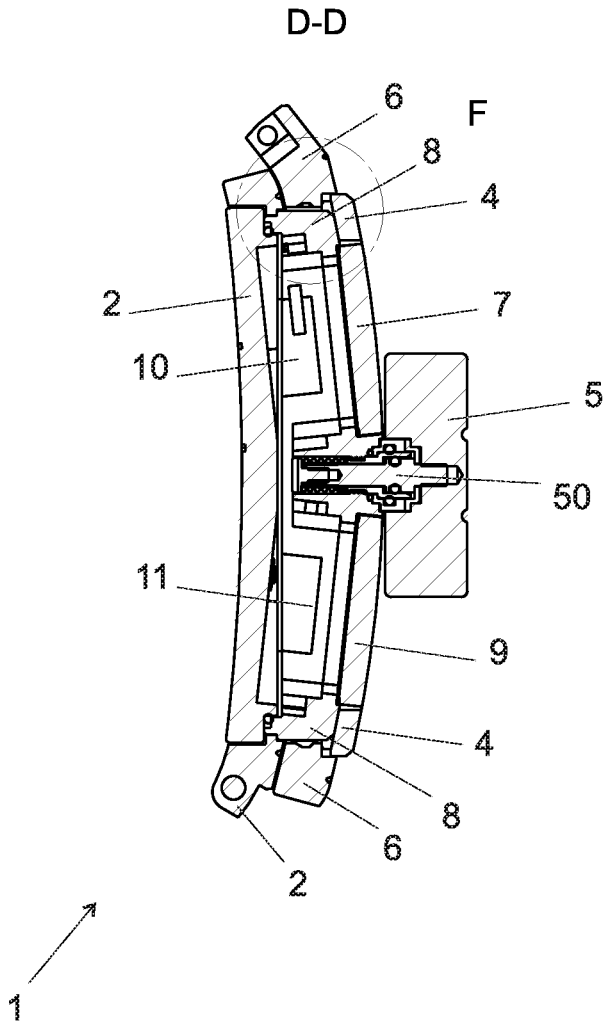
FIG. 8 is a view in longitudinal section on D-D of the watch of FIG. 6, without the bracelet.
Figure 9:
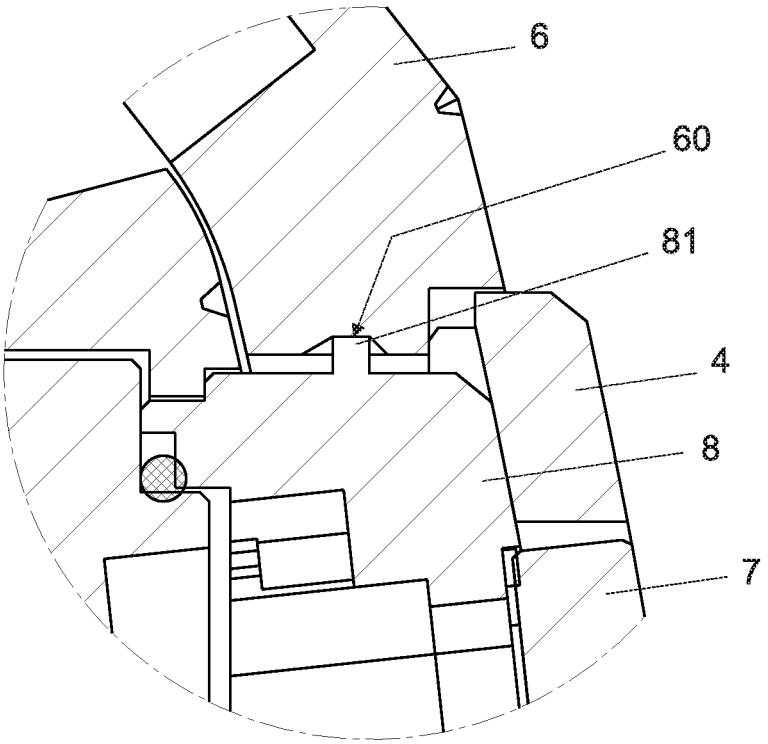
FIG. 9 is an enlargement of a portion of FIG. 8.
Figure 10:
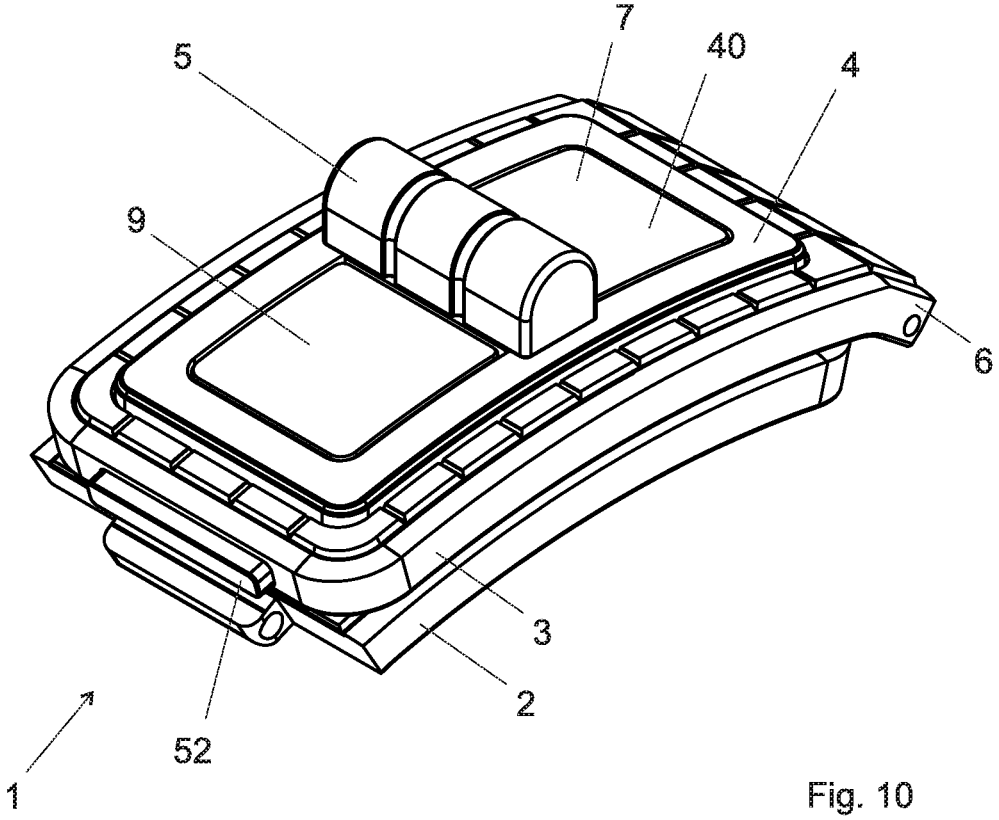
FIG. 10 illustrates a perspective view of a second embodiment of a wristwatch according to the invention, without the bracelet, the clasp being locked.

In the closed position, the clasp 3 can be locked on top of the case 2 using the locking member 5. The locking member 5 comprises a rod-shaped shaft 50 passing through the base 51 at the center of the watch case 2, and a head which can be pivoted by lifting the shaft between the longitudinal position of FIGS. 3 and 5 and the transverse position of FIG. 1. In the longitudinal position, as illustrated in FIG. 5, the head of the locking member 5 can be slipped through the opening 40 of the clasp frame 4 so as to close or open the clasp. The locking member can then be lifted up and then pivoted into the transverse position of FIG. 3, in order to rest on the upper face of the frame 4 thus preventing removal of the clasp 3.

The clasp described above is locked only by means of the locking member 5; if this locking member is not closed, for example as the result of an oversight or it becoming snagged, the closure of the bracelet is assured only by means of the spring-loaded balls 80 on one or both faces of the watch middle 8.

The second embodiment described in conjunction with FIGS. 10 to 12A (without the bracelet in order to make the figures less cluttered) offers additional security thanks to a push-button 52 on one of the longitudinal faces of the clasp 3, for example in the 6-o'clock position as illustrated, or in the 12-o'clock position. This push-button absolutely must be actuated in order to unfasten the clasp. This embodiment therefore offers dual security, by virtue of the locking member 5 on top of the upper face of the case, and the push-button 52 on one of the longitudinal faces of the clasp. These two elements need to be actuated consecutively in order to open the clasp. The locking of the locking member 5 is manual, by turning it. By contrast, the locking afforded by the push-button 52 may be automatic thanks to the springs 84 and 521 which push it back into the locking position. As in the previous embodiment, spring-loaded balls may also be provided on the longitudinal face of the clasp 3 opposite to the push-button 52 and/or on the same face, in order to offer additional security and produce an audible and tactile reaction when the clasp is opened.

The position of the push-button 52 on one of the longitudinal faces of the clasp 3 makes it possible to avoid the disadvantages of push-buttons projecting on the lateral faces, which carry the risk of digging into the wrist. The push-button 52 moves in a plane above the bracelet and cannot therefore come into contact with the wrist. This solution is advantageous for all clasps, even clasps with a deploying buckle which are not connected to the watch case.

Figure 11:
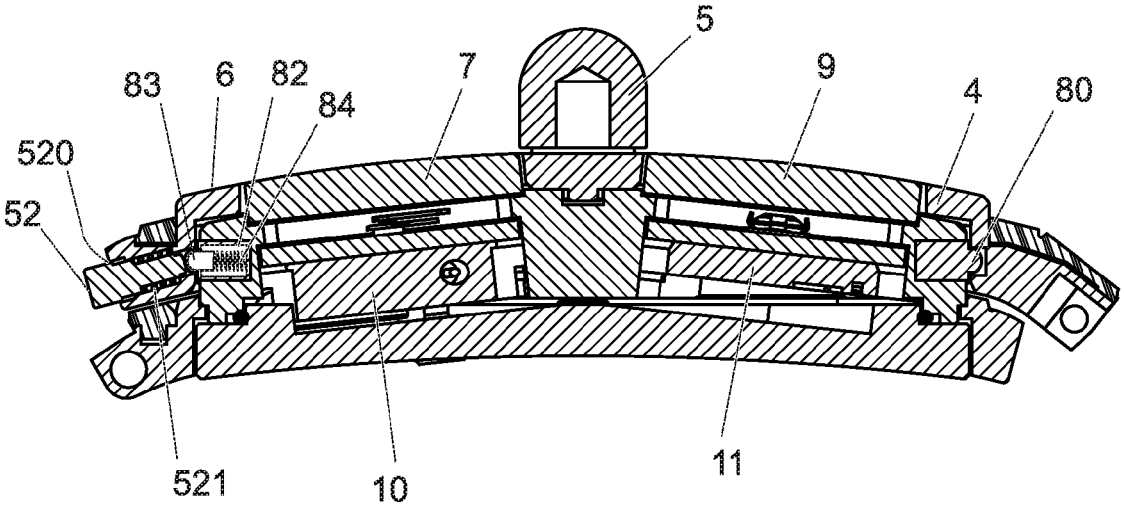
FIG. 11 is a view in longitudinal section of the watch of FIG. 10.
Figure 12:
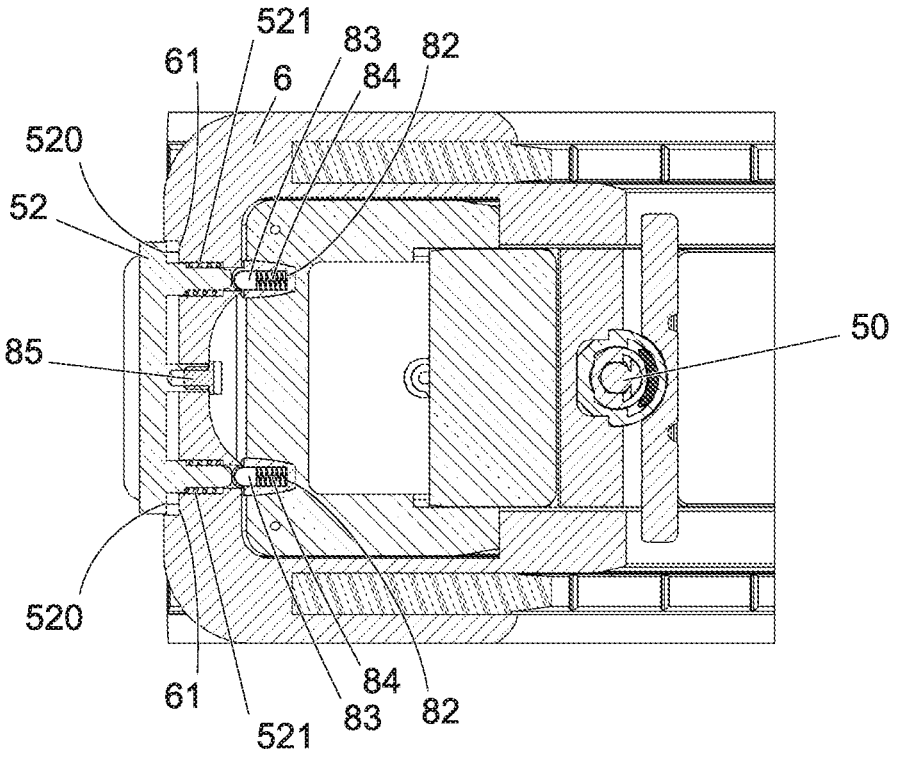
FIG. 12 is a view in section on F-F (FIG. 12A) of the watch of FIG. 10.
Figure 12A:
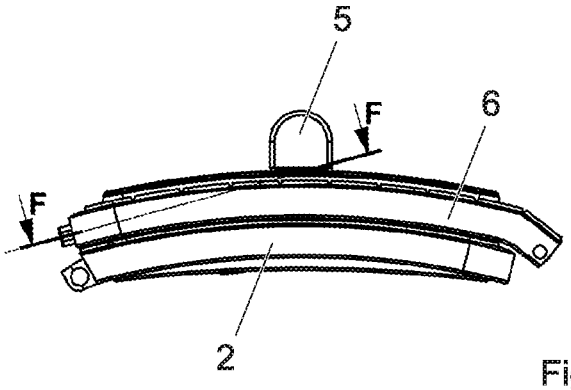

With reference to FIGS. 11 and 12, the push-button 52 comprises two rods 522 engaged in longitudinal through-holes through the clasp 3. A different number of rods, for example three rods, may be provided. A return spring 521 around each rod pushes the push-button 52 back outward, into the locked position. The outward travel of the button is limited by a screw 85 engaged in an additional hole between the two rods 522; this screw also acts as a guide element. Inward, the depth of penetration of the push-button 52 is limited by the shoulder 520 of the rods 522 which comes to bear against the bearing portion 61 of the clasp 3.

The end of the rods 522 presses against pivots or pins 83 engaged in blind holes 82 through the watch case 2. A spring 84 pushes each pivot back outward, while at the same time preventing it from completely exiting the blind hole. In the locking position illustrated, the pivots 83 protrude out of the lateral face of the watch case 2 and enter the through-holes in the clasp 3; they thus oppose the opening of the clasp 3 which cannot be lifted. By pressing the push-button 52, the rods 522 push the pivots 83 back flush with the watch case 2, thus releasing the clasp 3.

REFERENCE NUMERALS USED IN THE FIGURES

1 Wristwatch
2 Watch case
3 Clasp
4 Clasp frame
40 Opening in the clasp frame
5 Locking member
50 Shaft of the locking member
51 Base of the locking member
52 Push-button
520 Shoulder on the rods 52
521 Push-button return springs
522 Push-button rods
6 Base of the clasp
60 Positioning notch
61 Clasp bearing portion
7 First dial
8 Watch middle
80 Spring-loaded ball
81 Positioning shape
82 Blind hole on a longitudinal face of the watch middle
83 Pivot
84 Pivot retention and return spring
85 Push-button guidance and retaining screw
9 Second dial
10 First movement
11 Second movement
12 Bracelet
120 First end of the bracelet
121 Second end of the bracelet

The invention claimed is:

1. A wristwatch, comprising:
a watch case;
a clasp, said clasp comprising a frame that can clip over the top of the watch case in a closed position, and that can be unfastened from the watch case in an open position;
a bracelet, said bracelet comprising a single strand, said strand having a first end and a second end;
said first end being connected to said watch case and said second end being connected to the clasp;
a locking member connected to the watch case, the locking member being able to be pivoted between a position that allows it to be inserted into the opening of the frame when the clasp is being closed or opened, and a locking position that allows the opening or closure of the clasp to be blocked.

2. The wristwatch as claimed in claim 1, the watch comprising at least one dial, the frame comprising an opening, at least one said dial being visible through this opening.

3. The wristwatch of claim 1, the locking member having a T-shape with a pivoting shaft connected to the watch case, and a head that can be oriented either in a first direction that allows insertion of the clasp or in a second direction pressing against the frame of the clasp.

4. The wristwatch of claim 1, the watch case comprising spring-loaded balls able to collaborate with notches in the clasp in order to keep the clasp closed.

5. The watch as claimed in claim 4, the shaft of the locking member being able to be lifted above the dial in order to pivot it.

6. The wristwatch as claimed in claim 4, comprising two dials and a separation between these two dials, the shaft of the locking member being mounted on this separation.

7. The wristwatch as claimed in claim 6, comprising a first movement for displaying time information on a first of said dials.

8. The wristwatch as claimed in claim 7, comprising a second movement for displaying time information on the second of said dials.

9. The wristwatch as claimed in claim 1, the clasp comprising a push-button with a return spring, the return spring pushing the push-button back into the locking position when the push-button is not being pressed, the opening of the clasp being blocked in this locking position.

10. The wristwatch as claimed in claim 9, said push-button being provided on lateral faces of the clasp, so as to move in a plane above the bracelet.

11. The wristwatch as claimed in claim 10, said push-button comprising at least two rods engaged in through-holes through the clasp, each rod collaborating with a pivot engaged in the watch case so as to lock or unlock the clasp.

* * * * *